US010316848B2

(12) United States Patent
Grøtterud et al.

(10) Patent No.: US 10,316,848 B2
(45) Date of Patent: Jun. 11, 2019

(54) SYSTEM FOR PUMPING A FLUID AND METHOD FOR ITS OPERATION

(71) Applicant: FMC Kongsberg Subsea AS, Kongsberg (NO)

(72) Inventors: Helge Grøtterud, Kongsberg (NO); Terje Hollingsæter, Lommedalen (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 125 days.

(21) Appl. No.: 15/511,896

(22) PCT Filed: Sep. 15, 2015

(86) PCT No.: PCT/EP2015/071137
§ 371 (c)(1),
(2) Date: Mar. 16, 2017

(87) PCT Pub. No.: WO2016/041991
PCT Pub. Date: Mar. 24, 2016

(65) Prior Publication Data

US 2017/0260983 A1 Sep. 14, 2017

(30) Foreign Application Priority Data

Sep. 16, 2014 (NO) ..... 20141113

(51) Int. Cl.
*F04D 15/00* (2006.01)
*F04D 7/04* (2006.01)
(Continued)

(52) U.S. Cl.
CPC ..... *F04D 15/0066* (2013.01); *E21B 43/121* (2013.01); *F04D 7/04* (2013.01); *F04D 13/08* (2013.01); *F04D 15/0209* (2013.01)

(58) Field of Classification Search
CPC ..... F04D 7/04; F04D 13/08; F04D 15/0209; F04D 15/0066; E21B 43/121
(Continued)

(56) References Cited

U.S. PATENT DOCUMENTS 3,299,815 A 1/1967 Thaw
4,678,404 A * 7/1987 Lorett ..... F04D 15/0066 415/901
(Continued)

FOREIGN PATENT DOCUMENTS

CA 2 586 674 A1 10/2007
WO WO 2005/026497 A1 3/2005

*Primary Examiner* — Patrick Hamo
*Assistant Examiner* — Joseph S. Herrmann

(57) ABSTRACT

A method of operating a system (16) for pumping a fluid, which system comprises: a pump (17) for pumping the fluid; and a variable speed motor (20) for driving the pump (17). The method comprises the steps of: identifying a first system parameter (PI); identifying a second system parameter (P2) which is a function of the torque of the pump; setting a target value ($P1_0$) for a first system parameter; monitoring the first system parameter (PI); establishing a target value ($P2_0$) for the second system parameter based on the difference between the target value and the measured value of the first system parameter; monitoring the second system parameter; and regulating the rotational speed of the pump such that the difference between the monitored value and the target value of the second system parameter is minimized. A system for implementing the method is also disclosed.

12 Claims, 3 Drawing Sheets

(51) Int. Cl.
*F04D 13/08* (2006.01)
*F04D 15/02* (2006.01)
*E21B 43/12* (2006.01)

(58) Field of Classification Search
USPC ..... 318/471–473, 430–434
See application file for complete search history.

(56) References Cited

U.S. PATENT DOCUMENTS

| | | | | |
|---|---|---|---|---|
| 5,563,490 | A * | 10/1996 | Kawaguchi | F04D 15/0066 318/808 |
| 5,634,772 | A * | 6/1997 | Kawaguchi | F04D 13/04 417/22 |
| 6,564,627 | B1 * | 5/2003 | Sabini | F04D 15/0088 417/19 |
| 6,663,349 | B1 | 12/2003 | Discenzo et al. | |
| 7,117,120 | B2 * | 10/2006 | Beck | E21B 43/126 702/182 |
| 7,163,380 | B2 * | 1/2007 | Jones | F04B 49/065 417/44.1 |
| 2002/0136642 | A1 | 9/2002 | Moller | |
| 2002/0162402 | A1 | 11/2002 | Henyan | |
| 2009/0151801 | A1 | 6/2009 | Gorman et al. | |
| 2013/0272898 | A1 | 10/2013 | Toh et al. | |

* cited by examiner

SYSTEM FOR PUMPING A FLUID AND METHOD FOR ITS OPERATION

FIELD OF THE INVENTION

The present invention relates to method of operating a system for pumping a fluid, which system comprises:

a pump for pumping the fluid, and a variable speed motor for driving the pump.

The present invention also relates to a system for pumping a fluid, comprising:

a pump for pumping the fluid, a variable speed motor for driving the pump, and a first sensor device for monitoring a first system parameter.

In particular, the present invention relates to a method and a system for pumping a multi-phase fluid or a fluid having a variable density, e.g. a hydrocarbon fluid, in a subsea, topside or a land-based hydrocarbon processing facility, e.g. in a hydrocarbon well complex, a hydrocarbon transport facility, or any other type of facility where hydrocarbons are handled.

BACKGROUND

In conventional multi-phase fluid pumping systems, one or a plurality of system parameters are normally used to control one or a plurality of variable system parameters in order to keep the pump within a permissible operating region. The system parameters may, for example, comprise a parameter indicative of the differential pressure across the pump, e.g. the pump suction pressure, and the variable system parameters may, for example, comprise the rotational speed of the pump and/or the flow of fluid through a feed-back conduit leading from the discharge side to the suction side of the pump.

The operational range of a pump is generally illustrated in a DP-Q diagram (cf. FIG. 1). In the DP-Q diagram, the differential pressure over the pump is mapped against the volumetric flow through the pump, and the permissible operating region within the DP-Q diagram is identified. The border between the permissible operating region and an impermissible operating region is defined by the so called pump limit characteristics curve. Under normal conditions, the pump is operated only in the permissible operating region. However, if the pump enters the impermissible region, a pumping instability, or surge, may occur, in which case the pump may be subjected to a possible failure.

During operation of the system, the differential pressure across the pump and the flow of fluid through the pump may be monitored. If the monitored operating point approaches the pump limit characteristics curve, the rotational speed of the pump may be adjusted such that the pump is kept within the permissible operating region.

US 2002/0162402 A1 discloses a method for determining the flow rate through a pump based on a plurality of known speed and torque values. According to the method, characterising flow rate/torque information for the pump is retained and used to determine fluid flow rate at measured, non-characterized, speed and torque values. In order to establish the flow rate, the motor torque and the motor speed are measured and the corresponding flow rate value is looked-up in the retained flow rate/torque information.

However, in hydrocarbon fluid pumping applications, the gas volume fraction (GVF) and/or the density of the fluid may change quickly, e.g. due to gas and/or liquid slugs in the system. On the other hand, the differential pressure requirements across the pump will normally change relatively slowly due to slow changes in the production profile. With large volumes of compressible fluid upstream and downstream of the pump, and assuming that slug lengths are shorter than the lengths of the flow lines, the differential pressure requirement will be fairly constant, even if the pump sees density variations. As a consequence, a conventional multi-phase fluid pumping system using the differential pressure across the pump as a main parameter to control the system may not be fast enough to prevent the pump from entering the impermissible operating region.

The present invention addresses this problem, and an object of the invention is to provide a system for pumping a fluid and a method of operating the same which can react quickly to a change in the gas volume fraction and/or the density of the fluid.

SUMMARY OF THE INVENTION

The method according to the invention comprises the steps of:

identifying a first system parameter, identifying a second system parameter which is a function of the torque of the pump, setting a target value for the first system parameter, monitoring the first system parameter, establishing a target value for the second system parameter based on the difference between the target value and the measured value of the first system parameter, monitoring the second system parameter, and regulating the rotational speed of the pump such that the difference between the monitored value and the target value of the second system parameter is minimised.

The system according to the invention is characterised in that it comprises:

a second sensor device for monitoring a second system parameter which is a function of the torque of the pump, and a first controller arranged to receive monitored first system parameter values from the first sensor device and, for each monitored first system parameter value, establish a torque target value for the pump, and a second controller arranged to receive the torque target values from the first controller and monitored second system parameter values from the second sensor device and, for each monitored second system parameter value, compare the monitored second system parameter value with the latest torque target value established by the first controller, and regulate the rotational speed of the pump such that the difference between the monitored value of the second system parameter and the latest established torque target value is minimised.

The first system parameter may be a function of the differential pressure across the pump. In particular, the first parameter may be any one of the differential pressure across the pump, the suction pressure of the pump, and the discharge pressure of the pump. However, the first parameter may in principal be any parameter, i.e. a fluid level in a tank of the system, which is controlled by the flow rate.

Consequently, instead of using the first system parameter to directly control the rotational speed of the motor, the first system parameter is used to set a target value or set-point for a second system parameter which is a function of the pump torque. The second parameter is then monitored, and if the value of the monitored second system parameter deviates from the target value, the rotational speed of the pump is adjusted such that the pump is kept within its admissible operating region.

The invention is applicable to subsea, topside and land-based fluid pumping systems, e.g. hydrocarbon fluid pumping systems, in particular in systems in which the density of the fluid varies.

The step of monitoring a first system parameter may advantageously be done by using a first controller, and the step of monitoring the second system parameter may advantageously be done by using a second controller.

The first system parameter may advantageously be any one of a differential pressure across the pump and a suction pressure of the pump.

The second system parameter may advantageously be any one of a torque of the pump and a current in the windings of the motor.

The system may advantageously comprise a variable speed drive for operating the motor, and the step of monitoring the second system parameter may advantageously comprise sampling the second system parameter from the variable speed drive.

Consequently, according to the invention, a first system parameter, P1, which advantageously is a function of the differential pressure across the pump, and a second system parameter, P2, which is a function of the pump torque, are monitored during operation of the system.

The monitored value of the first system parameter, $P1_m$, is compared to a setpoint or target value, $P1_0$, for the first system parameter. Based on the monitored value $P1_m$, and the target value $P1_0$ of the first system parameter, a setpoint or target value, $P2_0$, for the second system parameter is established. In other words, the target value for the second system parameter, $P2_0$, is set as a function of the monitored value $P1_m$, and the target value $P1_0$ of the first system parameter, $P2_0=f(P1_m, P1_0)$, such that the difference between the monitored value $P1_m$ and the target value $P1_0$ of the first system parameter P1 is minimised. Advantageously, the target value $P2_0$ of the second system parameter P2 is set as a function of the difference between the monitored value $P1_m$ and the target value $P1_0$ of the first system parameter P1: $P2_0=f(P1_m-P1_0)$.

The monitored value of the second system parameter, $P2_m$, is then compared to the target value for the second system parameter $P2_0$. Based on the monitored value $P2_m$ and the target value $P2_0$ of the second system parameter, a pump speed control signal, $S_{speed}$, is established and, advantageously, sent to a variable speed drive controlling the motor of the pump. In other words, the pump speed control signal, $S_{speed}$, is set as a function of the monitored value $P2_m$ and the target value $P2_0$ of the second system parameter, $S_{speed}=f(P2_m, P2_0)$, such that the difference between the monitored value $P2_m$ and the target value $P2_0$ of the second system parameter P2 is minimised.

Consequently, according to the invention, the regulation of the pump motor is advantageously accomplished in a cascading fashion where the target value for the second system parameter, $P2_0$, is set in a first controller and the pump speed control signal, $S_{speed}$, is set in a second controller, wherein the second system parameter P2 is used as an intermediate control variable.

In the following, embodiments of the invention will be disclosed in more detail with reference to the attached drawings.

DETAILED DESCRIPTION OF THE INVENTION

Figure 1:
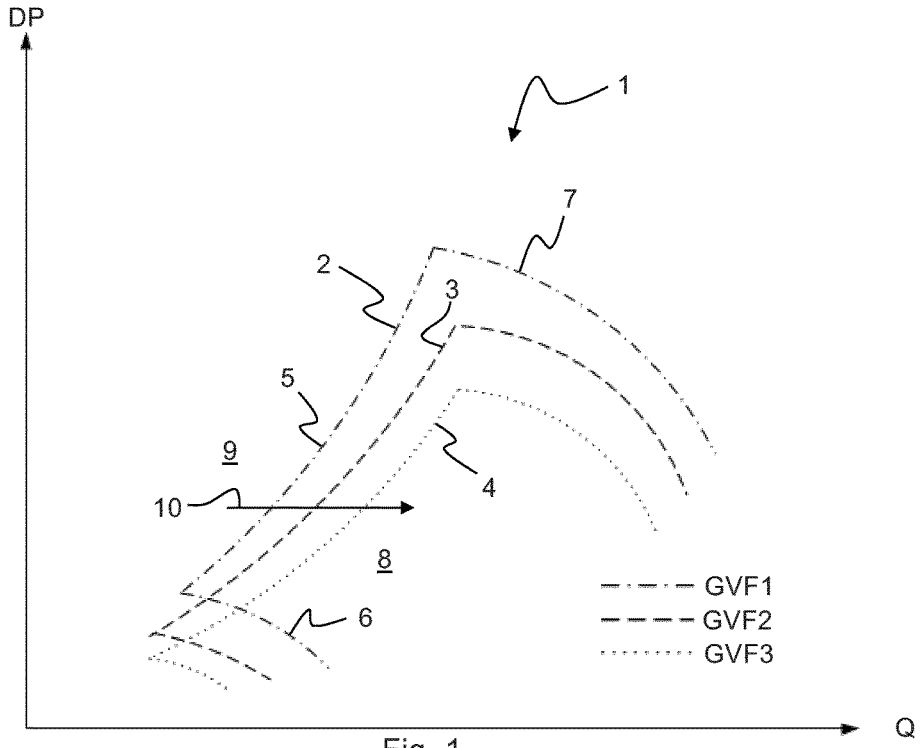
Fig. 1 (Prior Art)
FIG. 1 discloses a DP-Q diagram conventionally used to illustrate the operational range of a pump in a fluid pumping system.

FIG. 1 discloses a conventional pump limit characteristics diagram 1 for a hydrocarbon pump where the differential pressure DP across the pump is mapped as a function of the volumetric flow Q through the pump. This type of diagram is conventionally referred to as a DP-Q diagram. The diagram discloses a first pump limit characteristics curve 2 for a first gas volume fraction, GFV1, a second pump limit characteristics curve 3 for a second gas volume fraction, GFV2, and a third pump limit characteristics curve 4 for a third gas volume fraction, GFV3, of the fluid, where GFV1<GFV2<GFV3. Each pump limit characteristics curve 2-4 comprises a minimum flow curve section 5, a minimum speed curve section 6 and a maximum speed curve section 7 defining a permissible operation region 8 and an impermissible operation region 9 of the pump. When the GVF is increased, it is necessary to increase the pump speed (and flow) in order to maintain the same torque. As is shown in diagram 1, the operational point of the pump should be shifted when the gas volume fraction changes from GVF1 to GVF2 and then further to GVF3, as is indicated by the arrow 10.

Figure 2:
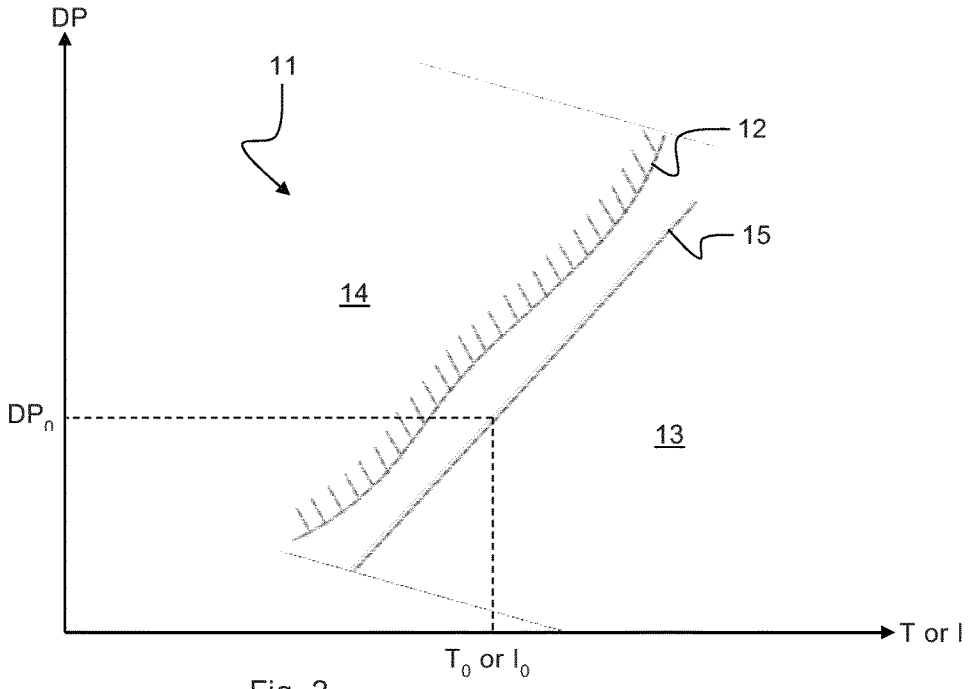
FIG. 2 discloses a diagram of an alternative, novel way of illustrating the operational range of a pump in a fluid pumping system.

FIG. 2 discloses an alternative pump limit characteristics diagram 11 for the pump where the differential pressure across the pump, DP, is mapped as a function of the pump torque T.

The differential pressure across the pump DP would in this instance be the first system parameter P1, and the second system parameter P2 would be the pump torque T.

The manner of establishing a pump limit characteristics diagram as disclosed in FIG. 2 is beneficial since it has been revealed that the minimum pump torque required to uphold a sufficient differential pressure across the pump is valid for different gas volume fractions and fluid densities. Consequently, instead of requiring pump limit characteristics curves for different GVFs and densities, only one pump limit characteristics curve 12 needs to be established. Therefore, the pump limit characteristics curve 12 defines second parameter values below which the pump may experience a pumping fault or surge, independent of the gas volume fraction and density of the fluid. The curve 12 separates a permissible operating region 13 from an impermissible operating region 14 of the pump. Consequently, for every differential pressure value, $DP_0$ ($P1_0$), it is possible to identify an allowable, desired torque value, $T_0$ ($P2_0$), thus establishing a pump operation curve 15 in the permissible operating region 13 positioned at a predetermined, safe distance from the pump limit characteristics curve 12. Consequently, for each differential pressure value $DP_0$ ($P1_0$) the torque value $T_0$ ($P2_0$) may be used as a setpoint or target value for the torque, or as a minimum allowable torque.

The method of operating a fluid pumping system according to the invention comprises the step of establishing a pump limit characteristics diagram 11 of the type disclosed in FIG. 2 by mapping a first system parameter P1 as a function of a second system parameter P2 identifying a permissible operating region 13 of the pump, wherein the second system parameter P2 is a function of the torque acting on the pump shaft.

The first system parameter P1 may advantageously be a function of a differential pressure across the pump. In particular, the first system parameter P1 may be any one of the differential pressure across the pump, the suction pressure of the pump, and the discharge pressure of the pump. However, the first parameter P1 may in principal be any parameter, i.e. a fluid level in a tank of the system, which is controlled by the flow rate.

As stated above, the second system parameter P2 may be the torque acting on the shaft of the pump. However, during normal operation of the pump, the motor current of the motor driving the pump, i.e. the current flowing in the windings of the pump motor, will generally be proportional to the pump torque. Consequently, the second system parameter P2 may alternatively be the winding current of the pump motor.

The method further comprises the step of identifying a minimum allowable second parameter value $P2_0$ for each first parameter value $P1_0$. The set of minimum allowable values $P2_0$ may be defined by the above-discussed pump operation curve 15. The set of minimum allowable second parameter values $P2_0$ may, for example, comprise a minimum allowable pump shaft torque value, $T_0$, or a minimum allowable pump motor current value $I_0$ for every differential pressure value $DP_0$, as is indicated in FIG. 2.

Once established, the set of minimum allowable second system parameter values $P2_0$ are stored in the system to provide reference values during its operation.

Figure 3:
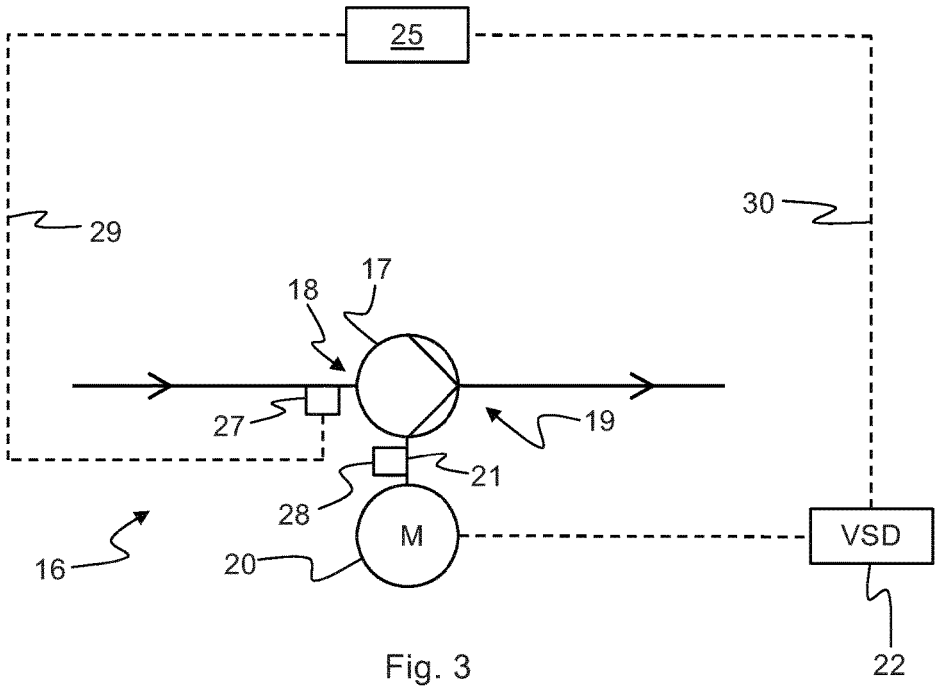
FIG. 3 discloses a hydrocarbon fluid pumping system according to an embodiment of the invention.

FIG. 3 discloses a hydrocarbon fluid pumping system 16 according to a preferred embodiment of the invention. The system comprises a pump 17 having a suction side 18 and a discharge side 19. The pump 17 may advantageously be a helicoaxial (HAP) or centrifugal type pump. The system 16 further comprises an electrical motor 20 for driving the pump 17 via a shaft 21. The motor 20 is a variable speed motor which is controlled by a variable speed drive, VSD 22.

In order to monitor the first parameter P1, the system 16 comprises a first measuring or sensor device 27. This sensor device 27 may be a pressure sensor arranged to monitor the differential pressure DP across the pump 17, the suction pressure of the pump 17 or the discharge pressure of the pump 17. However, as is discussed above, the first parameter P1 may in principal be any parameter which is a function or indicative of the flow rate and/or the head of the pump and the sensor device 27 should be chosen accordingly.

Also, in order to monitor the second parameter P2, i.e. the parameter indicative of the pump torque, the system 16 comprises a second measuring or sensor device 28. The second sensor device 28 may be a torque sensor arranged to monitor the torque T acting on the shaft 21 or, alternatively, a current sensor arranged to monitor the motor current I.

The monitored first parameter value is conveyed from the sensor device 27 to a control unit 25 via signal conduit 29.

When monitoring the second parameter P2, the most accurate parameter value is obtained by measuring the pump torque directly at the shaft 21. The monitored second parameter value may also be conveyed from the sensor device 28 to the control unit 25 via signal conduit 29. However, in subsea applications, it may be advantageous to sample the second parameter P2 from the VSD 22. In the VSD 22, signals indicative of the shaft torque are readily available. For example, the pump torque can easily be calculated from the power and the pump speed with the following function:

$$T=(P\cdot 60000)/(2\cdot\pi\cdot N)$$

where the torque T is given in Nm, the power P in kW and the pump speed N in rotations per minute.

Also, the signals of the VSD 22 are sampled with a relatively high sampling frequency which makes it possible to realise a responsive control system. Furthermore, in subsea hydrocarbon pumping systems, the VSD is generally more accessible than the pump-motor assembly since the VSD is normally positioned topside, i.e. above sea level.

If the second system parameter P2 is sampled from the VSD 22, the monitored second parameter values are advantageously conveyed from the VSD 22 to the control unit 25 via signal conduit 30.

Figure 4:
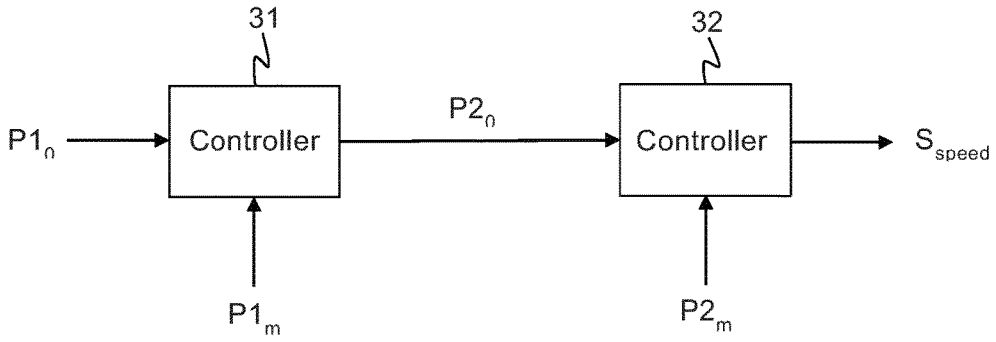
FIG. 4 is a block diagram schematically illustrating a method of regulating a hydrocarbon pumping system according to the invention.

In the following, a method of operating the system 16 will be discussed with reference to FIG. 4. The method comprises the step of monitoring a first system parameter P1 using a first controller 31. A setpoint or target value $P1_0$ and a measured value $P1_m$ of the first system parameter P1 is inserted into the first controller 31. The first system parameter P1 may advantageously be the differential pressure across the pump 17, the suction pressure of the pump 17 or the discharge pressure of the pump 17.

Based on the difference between the target value $P1_0$ and the measured value $P1_m$ of the first system parameter P1, the first controller 31 is configured to establish a setpoint or target value $P2_0$ for a second system parameter P2, which is a function of the torque of the pump 17. The second system parameter P2 may for example be the pump torque as measured at the shaft 21 or the motor current.

The method according to the invention further comprises the step of monitoring the second system parameter P2 using a second controller 32. The second controller 32 is arranged in series with the first controller 31 such that the target value $P2_0$ established by the first controller 31 is inserted into the second controller 32. A measured value $P2_m$ of the second system parameter P2 is also inserted into the second controller 32.

For each monitored value $P2_m$, the second controller 32 is configured to compare the monitored value $P2_m$ with the target value $P2_0$ and establish a control signal, $S_{speed}$, for regulating the rotational speed of the pump 17 such that the difference between the monitored value $P2_m$ and the target value $P2_0$ is minimised.

By minimising the difference between the monitored value $P2_m$ and the target value $P2_0$ of the second parameter P2, the difference between the monitored value $P1_m$ and the target value $P1_0$ of the first parameter P1 will also be minimised. Consequently, instead of having the main system parameter, i.e. P1, controlling the speed of the pump 17 directly, as is common in prior art systems, the first system parameter P1 is used to establish a target value $P2_0$ for the second system parameter, which target value $P2_0$ is then used to regulate the second system parameter P2 and, indirectly, also the first system parameter P1. Consequently, the second system parameter P2 can be looked upon as an intermediate system parameter by which the first, main system parameter P1 is indirectly controlled.

The controllers 31 and 32 may advantageously be positioned in the control unit 25.

As previously discussed, the differential pressure over the pump 20 normally varies relatively slowly due to large volumes of hydrocarbon fluid upstream and downstream of the pump. However, the gas volume fraction and/or the density of the hydrocarbon fluid may change quickly, e.g. due to gas and/or liquid slugs in the system. Consequently, the pump torque may also changes relatively quickly. Therefore, in order to enable the system to react quickly to a change in the gas volume fraction and/or the density of the hydrocarbon fluid, it may be advantageous to arrange the system such that the second controller 32 reacts faster to changes in the second system parameter P2 than the first controller 31 does to changes in the first parameter P1. In other words, it may be advantageous to arrange the system such that the second controller 32 has a shorter response time than the first controller 31.

As previously discussed, the first system parameter P1 may advantageously be the differential pressure across the pump 17 or the suction pressure of the pump 17 and may advantageously be measured or sampled by the means of the first sensor 27. The second system parameter P2 may advantageously be any one of the pump torque as measured at the shaft 21 or the motor current and may be measured by means of the second sensor device 28.

Figure 5:
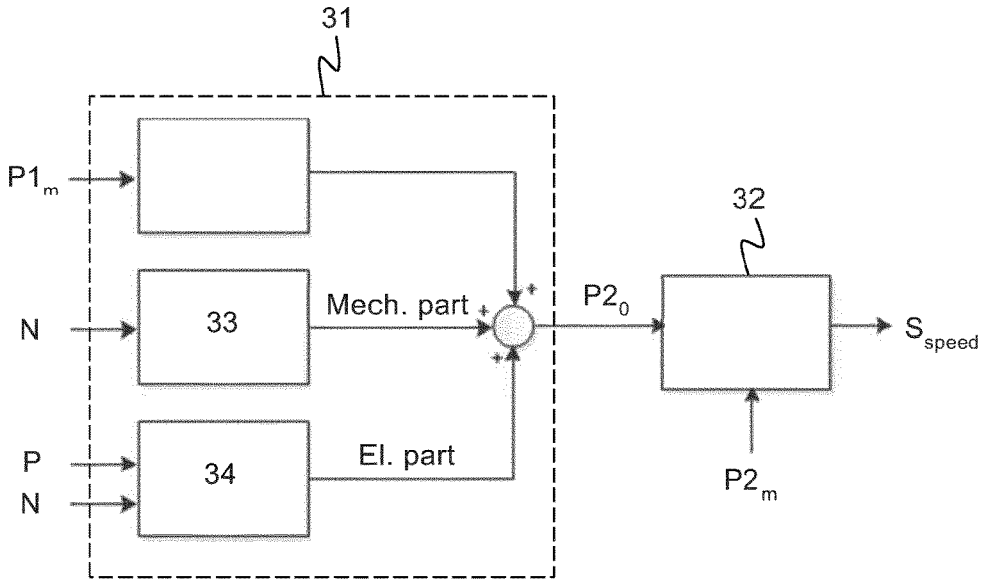
FIG. 5 is a block diagram schematically illustrating an alternative method of regulating a hydrocarbon pumping system according to the invention.

However, as also previously discussed, the second system parameter P2 may be sampled from the variable speed drive 22. In such a case, it may be advantageous to adjust the target value $P2_0$ such that mechanical losses in the motor 20 and electrical losses in cables and transformers between the variable speed drive 22 and the motor 20 are compensated for prior to inserting the target value $P2_0$ into the second controller 32. Such a compensation set-up is illustrated in FIG. 5. For example, mechanical losses in the motor 20 may be calculated based on the rotational speed N of the pump, as is illustrated by reference numeral 33, and electrical losses may be calculated based on the power P and the pump speed N, as is illustrated by reference numeral 34.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention.

The invention claimed is:

1. A method of operating a system for pumping a fluid, the system including a pump for pumping the fluid and a variable speed motor for driving the pump, the method comprising:

identifying a first system parameter (P1);

identifying a second system parameter (P2) which is a function of a torque of the pump;

setting a target value ($P1_0$) for the first system parameter (P1);

monitoring the first system parameter (P1);

establishing a target value ($P2_0$) for the second system parameter (P2) based on the difference between the target value ($P1_0$) and the monitored value ($P1_m$) of the first system parameter (P1);

monitoring the second system parameter (P2); and regulating the rotational speed of the pump such that the difference between the monitored value ($P2_m$) and the established target value ($P2_0$) of the second system parameter (P2) is minimised.

2. The method according to claim 1, wherein the step of monitoring the first system parameter (P1) is accomplished using a first controller and the step of monitoring the second system parameter (P2) is accomplished using a second controller.

3. The method according to any one of claims 1 and 2, wherein the first system parameter (P1) is a function of the differential pressure across the pump.

4. The method according to claim 3, wherein the first system parameter (P1) is a differential pressure across the pump, a discharge pressure of the pump or a suction pressure of the pump.

5. The method according to any one of claims 1 and 2, wherein the second system parameter (P2) is the torque of the pump or a motor current of the motor.

6. The method according to any one of claims 1 and 2, wherein the system comprises a variable speed drive for operating the motor, and wherein the step of monitoring the second system parameter (P2) comprises sampling the second system parameter (P2) from the variable speed drive.

7. The method according to claim 2, wherein the second controller has a response time which is shorter than the response time of the first controller.

8. The method according to claim 1, wherein said fluid is a hydrocarbon fluid.

9. A system for pumping a fluid, comprising:

a pump for pumping the fluid;

a variable speed motor for driving the pump;

a first sensor device for monitoring a first system parameter (P1);

a second sensor device for monitoring a second system parameter (P2) which is a function of a torque of the pump;

a first controller arranged to receive the monitored first system parameter values ($P1_m$) from the first sensor device and, for each monitored first system parameter value ($P1_m$), determine a difference between the monitored first system parameter value ($P1_m$) and a target first system parameter value ($P1_0$) and establish a torque target value ($P2_0$) for the pump based on said difference between the monitored first system parameter value ($P1_m$) and the target first system parameter value ($P1_0$); and a second controller arranged to receive the torque target values ($P2_0$) from the first controller and the monitored second system parameter values ($P2_m$) from the second sensor device and, for each monitored second system parameter value ($P2_m$), compare the monitored second system parameter value ($P2_m$) with a latest torque target value ($P2_0$) established by the first controller and regulate the rotational speed of the pump such that the difference between the monitored second system parameter value ($P2_m$) and the latest established torque target value ($P2_0$) is minimised.

10. The system according to claim 9, wherein the first system parameter (P1) is a function of the differential pressure across the pump.

11. The system according to any one of claims 9 and 10, wherein the first system parameter (P1) is a differential pressure across the pump, a discharge pressure of the pump or a suction pressure of the pump.

12. The system according to any one of claims 9 and 10, wherein the second system parameter (P2) is the torque of the pump or a motor current of the motor.

* * * * *